United States Patent [19]

Pollasky

[11] Patent Number: 4,947,602

[45] Date of Patent: Aug. 14, 1990

[54] WARP AND CURL RESISTANT WOOD PLATFORM MATTING

[76] Inventor: Anthony D. Pollasky, 9920 N. 190th St., Forest Lake, Minn. 55025

[21] Appl. No.: 205,869

[22] Filed: Jul. 26, 1988

[51] Int. Cl.[5] ..... E04F 13/08

[52] U.S. Cl. ..... 52/385; 52/602

[58] Field of Search ..... 52/384, 385, 581, 661, 52/662, 827–830; 15/215–217, 238; 404/35; 428/45, 50, 537.1

[56] References Cited

U.S. PATENT DOCUMENTS

| | | | |
|---|---|---|---|
| 441,785 | 12/1890 | White | 15/215 |
| 491,851 | 2/1893 | Morton | 15/215 X |
| 856,409 | 6/1907 | MacDonald | 404/35 X |
| 1,520,313 | 12/1924 | Skinner et al. | 428/50 |
| 1,660,480 | 2/1928 | Daniels | 428/50 X |
| 2,138,085 | 11/1938 | Birtles | 15/215 |
| 2,194,653 | 3/1940 | Gell | 52/662 |
| 2,235,230 | 3/1941 | Malarkey | 428/50 |
| 3,562,086 | 2/1971 | Kantor | 15/215 X |
| 3,616,115 | 10/1971 | Klimmek | 428/45 |
| 4,289,420 | 9/1981 | Davis et al. | 404/35 |

OTHER PUBLICATIONS

Advertising brochure, 4 pages, Angus-Stuart, Inc., P.O. Box 6156, Banning, CA 92220-0914.

*Primary Examiner*—David A. Scherbel
*Assistant Examiner*—Creighton Smith
*Attorney, Agent, or Firm*—Sten E. Hakanson

[57] ABSTRACT

A floor platform or matt for placing over a portion of existing flooring. The matt having a composite structure including a bottom hardboard layer, a middle hardboard layer adhered thereto. The bottom and middle layers cut into two pieces forming seams running the length of the matt, and the seams being displaced from each other. The matt also having a top hardwood finish layer consisting of a plurality of interlocking tiles. The tiles consist primarily of several individual hardwood strips flexibly held together by metallic strips, and the tiles are adhered to the middle layer. Reduction trim pieces are attached to the perimeter of the bottom and middle layers and include grooves for interlocking with the tiles. A support structure is secured to the bottom of the central region of the matt. The support structure includes gripping appendages integral therewith and extending therefrom.

17 Claims, 2 Drawing Sheets

WARP AND CURL RESISTANT WOOD PLATFORM MATTING

BACKGROUND OF THE INVENTION

1. Field of the Invention.

The present invention relates generally to matt or platform flooring units used to place over a portion of existing flooring to provide for protection thereof, and to provide for different floor surface characteristics, and relates more specifically to such flooring units that are manufactured of wood.

2. Background

Platform or matt flooring units can be removably placed over existing flooring to provide for a portion thereof having different surface characteristics. A well known example is seen in carpeted offices wherein a platform or matt, typically made of a relatively thin but durable and firm plastic material, is placed behind a desk to prevent excess wear of the carpet and to allow for easier movement of a caster supported desk chair.

Such prior art plastic matts function well yet are not particularly aesthetically pleasing. Thus, matts made of wood have been proposed that provide for a hard protective surface and that are also attractive. These wood matts consist essentially of a single piece of a thin planar wood fiber board material ,such as plywood or chipboard, to which is glued a finish hardwood. However, these prior art wood matts have been observed to warp or curl up at the edges, which is unsightly and impairs the effective use thereof. Warping can be caused by environmental factors, such as excessive humidity. Upward curling of the corners can result from the fact that, during use, weight is generally bearing primarily on the central portion of the matt causing that portion to become depressed relative to the corners. Also, the finish surface wood generally consists of thin individual hardwood wood strips which can become detached from the underlying support board as a result of this curling, further detracting from the appearance and usefulness thereof.

It would therefore be very desirable to have a floor matt constructed of wood that is resistant to curling and is more durable than the wood matts seen in the prior art.

SUMMARY OF THE INVENTION

The present invention consists of a wood floor mat having a unique composite structure providing for curl or warp resistance and for an enhanced overall durability. The invention herein includes a first lower layer cut to the desired dimension consisting of a thin hardboard material tempered o one side and rough on the side opposite thereto. This hardboard material is nominally one-eighth of an inch thick and is homogeneous in structure consisting of relatively fine and tightly compressed wood fiber particles. A second middle layer is adhered to the top or tempered surface of the lower layer. The middle layer is the same overall dimension as the lower layer, and consists of the same thickness and type of hardboard material, except that it is tempered or hardened on both sides. In the preferred form of the present invention both the top and bottom layers consist of two pieces, each layer being cut along the length dimension thereof. The layers are cut so that when adhered together the seams thereof do not overly each other, and in fact are separated by a distance equalling approximately one-third the width dimension of the layers.

A top or finish layer is in turn adhered to the top side of the middle layer opposite to the side thereof to which the bottom layer is adhered. The top layer consists of individual strips of a desired hardwood. In the preferred form the strips are approximately seven-eighths of an inch wide, by six inches long, by five-sixteenths inch thick, and are secured together into six inch squares by steel wire. The wire is imbedded into, and secured to the bottom or unfinished side of the strips and allows for a small gap between the finish strips. Each of the finish wood squares includes tongue and groove edges so that they can be interlocked with each other. A specially designed solid wood reduction trim or moulding extends around, and is secured to the perimeter of the matt and includes grooves for interlocking with the finish wood squares.

A friction support is secured to and covers a portion of the central region of the matt on the bottom thereof. The support is preferably made of a firm rubber material, is generally round in shape and having a maximum thickness of approximately five-sixteenths of an inch thick Which gradually tapers or reduces in thickness to the perimeter edge thereof. A plurality of gripping fingers or projections extend a short distance from the surface of the support.

It can be appreciated that the present invention consists of a unique layered wood matt structure. This composite structure was found to be stronger and more resistant to warping than prior art wood matts. In particular, it was found that the use of hardboard for the middle and bottom layers, and the sectioning thereof, provides for a more durable matt and one less susceptible to the effects of humidity and heat. Also, the interlocking finish squares and perimeter trim provide for enhanced strength and warp resistance. Moreover, the trim provides for improved appearance, and for gradual reduction of the height of the matt to the level of the floor.

In addition, the central support serves to prevent the depression of the central matt area that can result from weight bearing primarily thereon The support serves to add thickness to the central area so as to compensate for any sinking of the center of the matt that may occur over time. Also, the gripping fingers thereon serve to resist any tendency for the matt to slide.

It was also found that the steel wires that hold the finish strips together apparently serve to reduce the tendency for any static electricity to build up in the matt.

The objects and advantages of the present invention include, but are not limited to, the following:

1. To provide for a wood flooring portion or matt that is both functional and aesthetically pleasing.

2. To provide for a wood flooring portion or matt that is resistant to warping that can result from changes in temperature and humidity.

3. To provide for a wood flooring portion or matt that is resistant to the upward curling of the corners thereof that can result from weight bearing primarily on the central portion thereof.

4. To provide for a floor portion or matt that reduces any tendency thereof to store static electricity.

BRIEF DESCRIPTION OF THE DRAWINGS

A more thorough understanding of the present invention, and of its objects and advantages can be had in light if the following detailed description which refers to the following figures, wherein:

FIG. 3 is an enlarged sectional view along lines 3—3 of FIG. 1.

DETAILED DESCRIPTION OF THE PRESENT INVENTION

Figure 1:
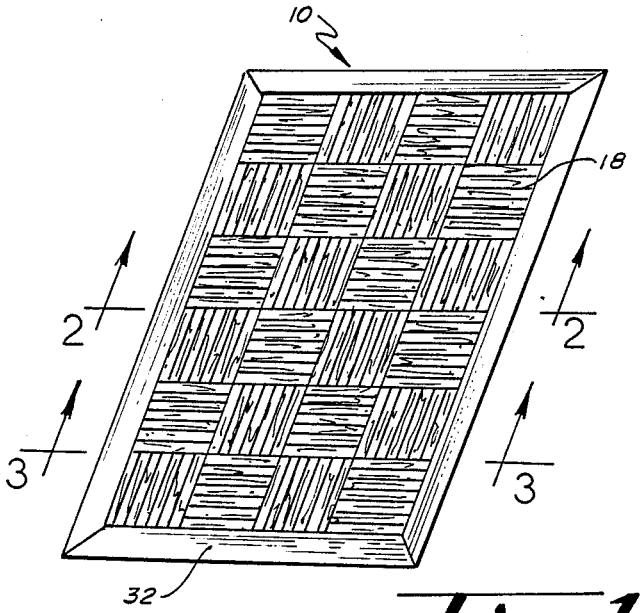
FIG. 1 is a top perspective view of the present invention.
Figure 2:
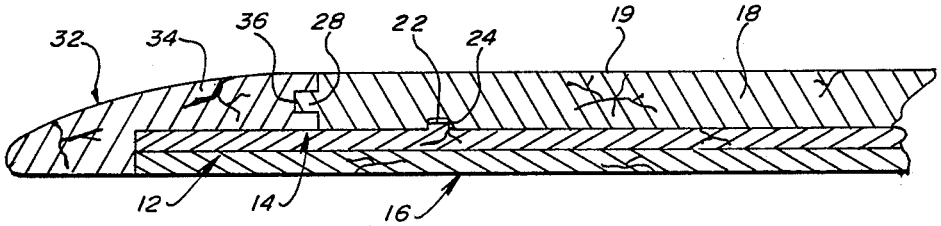
FIG. 2 is an enlarged sectional view along lines 2—2 of FIG 1.
Figure 4:
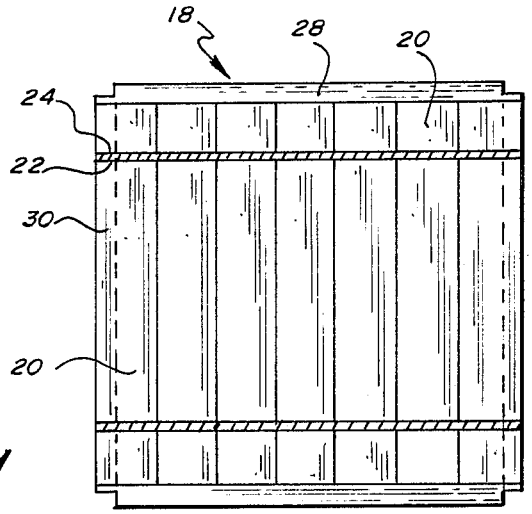
FIG. 4 is a bottom plan view of an interlocking tile of the present invention.
Figure 7:
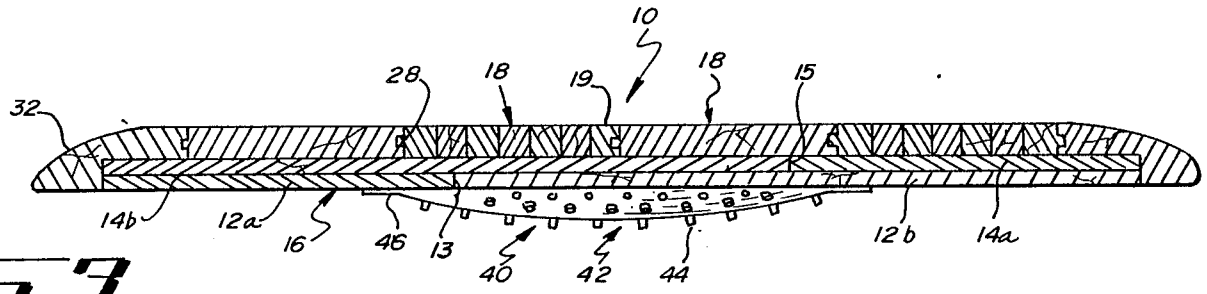
Figure 5:
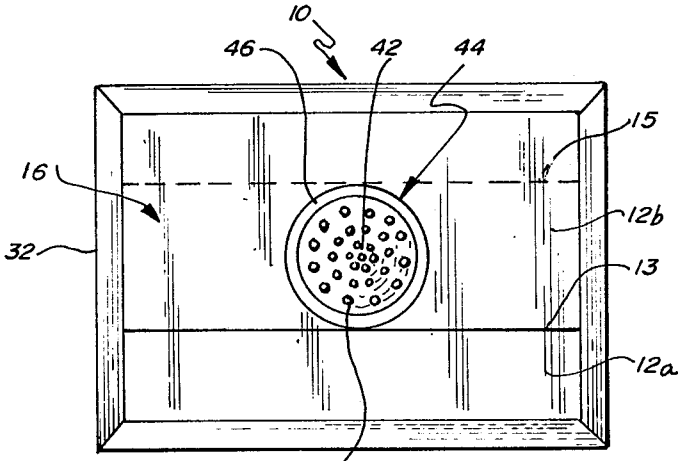
FIG. 5 is a bottom plan view of the present invention.

As seen in FIG'S. 1, 2 and 3, the flooring portion or matt of the present invention is generally referred to by numeral 10. Matt 10 includes a bottom layer 12 and a middle layer 14 Layers 12 an 14 are both one-eighth of an inch thick compressed hardboard material. Middle layer 14 is preferably tempered, or strengthened on both sides, whereas layer 12 is preferably tempered on the side thereof facing layer 14 and is untempered on the bottom side 16 thereof. As seen in FIG.'S 3 and 5, layers 12 and 14 actually consist of two sections each, portions 12*a* and 12*b*, and 14*a* and 14*b*, respectively. Portions 12*a* and 12*b* form a seam 13, and portions 14*a* and 14*b* form a seam 15. Seam 13 extends along the length of matt 10 essentially under the mid-point of portion 14*b*, and seam 18 extends along the length of matt 10 essentially over the midpoint of section 12*b*. Layers 12 and 14, as made up of sections 12*a* and 12*b* , and sections 14*a* and 14*b*, are secured together preferably with a construction grade adhesive that retains its resiliency over time and does not become entirely brittle.

Matt 10 also includes a top layer consisting of a plurality of wood tiles or squares 18 having a top finish surface 19. Tiles 18 are secured to middle layer 14 by an industrial adhesive as with the adhering of layer 12 to layer 14. As seen by also referring to FIG. 3, each tile 18 includes several individual strips 20 consisting of a solid finish hardwood, such a oak. Strips 20 are rectangular in shape and lie alongside each other along their length dimension. Strips 20 are held together by a pair of steel shanks or wires 22. Wires 22 are press fit into a pair of common grooves 24, extending along and slightly into the bottom surfaces 26 of strips 20, adjacent each of the ends thereof. It is preferable that strips 20, when held together by wires 22, are maintained at a slight distance apart. In this manner strips 20 can expand and contract as the result of humidity or temperature changes without causing warping or other undesirable consequences. Also, it is preferred if the tiles are impregnated with finish so as to allow for improved wear characteristics. The perimeter of tiles 18 are milled so as to form a pair of tongues 28 and grooves 80 to allow for interlocking between tiles 18. Such above described wood tiles are commonly available, and in the preferred form of the present invention, measure six inches by six inches, and are five-sixteenths of an inch thick. In the preferred form, each of the individual strips 20 are seven-eighths of an inch wide resulting in seven strips 20 in each tile is. Also, such tiles are made to interlock so as to provide for a desirable parquet floor appearance. However, various other interlocking tiles could be used having ,for example, different overall dimensions or number of strips. In fact, tiles 18 could consist of a single piece of wood without individual strips 20. Also, strips 20 can be held together with a variety of means not including steel wire or shank. The use of aluminum wire or shank connecting means is known in the art to provide for strip connection. However, the aluminum connecting means does not appear to be as effective in reducing static electricity buildup as with a ferrous metal connecting means.

Reduction trim pieces 82 extend around the perimeter of layers 12 and 14. Each trim piece 32 includes an overhang portion 34 and a groove 36. Trim 32 is secured to matt 10 by a plurality of staples, not shown, extending through overhang 34 and into layers 12 and 14. Groove 36 provides for interlocking engagement with tongues 28 of tiles 18.

As seen in FIG's. 4 and 5, matt 10 includes a support pad 40. Support pad 40 is attached to the bottom surface 16 of layer 12. Pad 40 is preferably circular in shape and made of a firm yet resilient material such as a hard rubber, although various materials would be suitable, such as a resilient plastic. Pad 40 is five-sixteenths of an inch thick at its midpoint 42, and tapers in a gradual arc to bottom surface 16. Pad 40 also preferrably includes a plurality of appendages or gripping members 44 integral therewith and extending therefrom. Pad 40 also includes a perimeter lip 46. Lip 46 provides for securing of pad 40 to surface 16 such as by staples, not shown, extending therethrough into layers 12 and 14. Support 40, gripping members 44 and lip 46 preferably exist as a unitary molded or formed structure.

It can be appreciated by those of skill in the art, that the composite structure of matt 10 provides for increased strength and resistance to warping or curling of the edges. In particular, the cutting of each of the layers 12 and 14 into two pieces results in a stronger matt, and resists warping by providing for a discontinuity that minimizes the effects thereof as compared to the situation that would prevail if layers 12 and 14 where each single homogeneous structures. Moreover, seams 13 and 15 are substantially displaced to avoid what would be a Weakening situation if seam 13 lay directly under or closely adjacent seam 15. Strength also results from tiles 18 interlocking with each other and with reduction trim 32, and from the tempering of layers 12 and 14. Layers 12 and 14 could however remain untempered on either or both sides thereof, or consist of a hardboard or wood fiber layer of equivalent strength and dimension.

Support 40 is of most value when mat 10 is used over a carpeted floor. Support 40 can then be pushed into the carpet and serves to compensate for any depression of the center thereof by adding extra support to that central area. Also, it can be seen that appendages 44 prevent sliding of matt 10 by providing for added frictional resistance especially, on a carpeted floor. Thus, support 40 with appendages 44 can serve a dual role of matt support and of preventing matt sliding. It can be understood that the rough nature of an untempered hardboard surface, such as bottom surface 16, can also provide for substantial frictional slide resistance. However, it is contemplated that bottom layer 12 could be tempered, and therefore smooth on its bottom side 16, if used in conjunction with a support 40 having gripping means 44.

What is claimed is:

1. A matt for covering a portion of a floor, comprising: a first bottom hardboard layer having a bottom surface and a top surface, a second middle hardboard layer having a bottom surface and a top surface and the bottom surface of the middle layer adhered to the top surface of the bottom layer, a plurality of interlocking wood tiles, the tiles adhered to the top surface of the middle layer, and reduction trim pieces secured to and extending around the perimeter of the first and second layers.

2. The matt is described in claim 1, wherein the bottom layer consists of a pair of bottom layer portions, the bottom layer portions defining a bottom layer seam extending along the matt, and wherein the middle layer consists of a pair of middle layer portions, the middle layer portions defining a middle layer seam extending along the matt and wherein the middle layer seam and the bottom layer seam are substantially displaced from each other.

3. The matt as described in claim 1, wherein the reduction trim pieces include groove means for providing interlocking of the tiles there with.

4. The matt as described in claim 1, wherein the top surface of the bottom layer is tempered, and wherein the top and bottom surfaces of the middle layer are tempered.

5. The matt as described in claim 1, and each of the interlocking wood tiles consisting primarily of a plurality of individual wood strips.

6. The matt as described in claim 5, wherein the interlocking tiles include wire means for holding the individual wood strips together and for providing spacing therebetween.

7. The matt as described in claim 1, and further including a support secured to the bottom surface of the bottom layer.

8. The matt as described in claim 7, wherein the support pad includes a plurality of gripping members integral therewith and extending therefrom.

9. A matt for covering a portion of a floor, comprising: a first bottom hardboard layer having a bottom surface and a top surface, a second middle hardboard layer having a top surface and a bottom surface and the bottom surface of the middle layer adhered to the top surface of the bottom layer, and the top surface of the bottom layer being tempered, and the top and bottom surfaces of the middle layer being tempered, a plurality of interlocking wood tiles, the tiles adhered to the top surface of the middle layer and reduction trim pieces secured to and around the perimeter of the first and second layers and the trim pieces including means for providing interlocking with the tiles.

10. The matt as described in claim 9, wherein the bottom layer consists of a pair of bottom layer portions, the bottom layer portions defining a bottom layer seam extending along the matt, and wherein the middle layer consists of a pair of middle layer portions, the middle layer portions defining a middle layer seam extending along the matt and wherein the middle layer seam and the bottom layer seam are substantially displaced from each other.

11. The matt as described in claim 9, and each of the interlocking wood tiles consisting primarily of a plurality of individual wood strips.

12. The matt as described in claim 11, wherein the interlocking tiles include wire means for holding the individual wood strips together and for providing spacing therebetween.

13. The matt as described in claim 9, and further including a support secured to the bottom surface of the bottom layer.

14. The matt as described in claim 13, wherein the support pad includes a plurality of gripping members integral therewith and extending therefrom.

15. A matt for covering a portion of a floor, comprising: a first bottom hardboard layer having a bottom surface and a top surface, a second middle hardboard layer having a bottom surface and a top surface, and wherein the bottom surface of the middle layer is adhered to the top surface of the bottom layer and wherein the top surface of the bottom layer is tempered, and wherein the top and bottom surfaces of the middle layer are tempered, and wherein the bottom layer consists of a pair of bottom layer portions, the bottom layer portions defining a bottom layer seam extending along the matt, and wherein the middle layer consists of a pair of middle layer portions, the middle layer portions defining a middle layer seam extending along the matt wherein the middle layer seam and the bottom layer seam are substantially displaced from each other, a plurality of interlocking wood tiles, the tiles adhered to the top surface of the middle layer, and each of the interlocking wood tiles consisting primarily of a plurality of individual wood strips wherein the interlocking tiles include wire means for holding the individual wood strips together and for providing spacing therebetween, and reduction trim pieces secured to and around the perimeter of the first and second layers and wherein the reduction trim pieces include groove means for providing interlocking with the tiles.

16. The matt as described in claim 18, and further including a support secured to the bottom surface of the bottom layer.

17. The matt as described in claim 15, wherein the support pad includes a plurality of gripping members integral therewith and extending therefrom.

* * * * *